US005927367A

United States Patent [19]

Toti

[11] Patent Number: 5,927,367

[45] **Date of Patent: *Jul. 27, 1999**

[54] TRACK SYSTEM, INCLUDING STABILIZED, OFFSET-WHEEL CARRIERS

[76] Inventor: Andrew J. Toti, 311 West River Rd., Modesto, Calif. 95351

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,900

[22] Filed: Mar. 19, 1997

[51] Int. Cl.[6] ..... E06B 9/30

[52] U.S. Cl. ..... 160/173 V; 160/84.04

[58] Field of Search ..... 160/173 V, 168.1 V, 160/176.1 V, 177 V, 172 V, 900, 84.01, 345, 196.1, 199, 178.1 V, 115, 84.04; 16/87.2, 87.4 R, 94 D, 96 D; 49/409

[56] References Cited

U.S. PATENT DOCUMENTS

| | | | |
|---|---|---|---|
| 2,100,882 | 11/1937 | Tamsitt | 160/196.1 X |
| 3,058,147 | 10/1962 | Bell | 16/95 D X |
| 3,335,784 | 8/1967 | Risk et al. | 160/199 |
| 3,844,330 | 10/1974 | Hyman | 160/168.1 V |
| 3,871,082 | 3/1975 | Pflum | 16/87.4 R X |
| 4,555,828 | 12/1985 | Matimura | 49/409 X |
| 4,852,628 | 8/1989 | Klein | 160/199 |
| 5,036,953 | 8/1991 | Munz | 160/196.1 X |
| 5,090,171 | 2/1992 | Kano et al. | 49/409 X |
| 5,542,149 | 8/1996 | Yu | 16/87.4 R |
| 5,597,026 | 1/1997 | Fuentes et al. | 160/115 |

*Primary Examiner*—David M. Purol
*Attorney, Agent, or Firm*—Philip A. Dalton

[57] ABSTRACT

A track and carrier system for window blinds is disclosed, which incorporates two dimensional spacing between the carrier support wheels, and, preferably three dimensional, x, y and z spacing between the carrier support wheels. Window covering systems are disclosed which use various types of blinds.

12 Claims, 8 Drawing Sheets

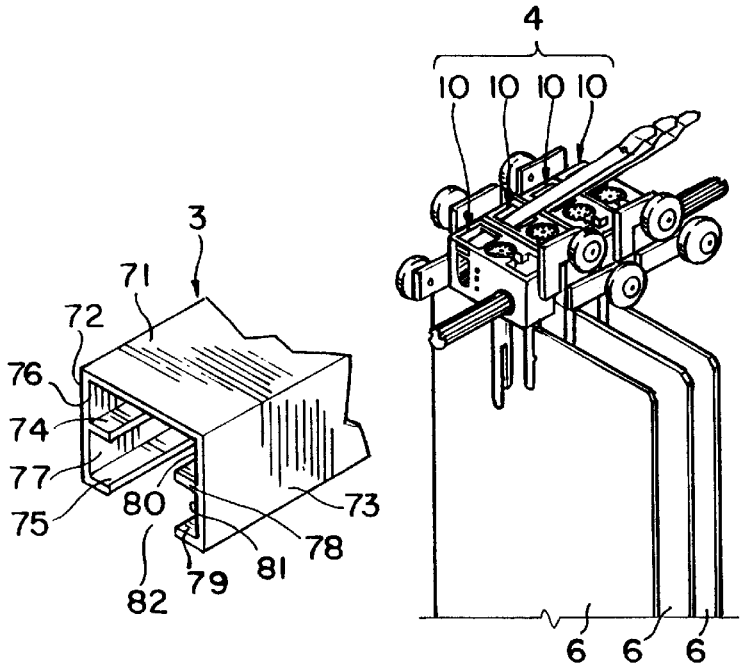
FIG. 7
FIG. 8
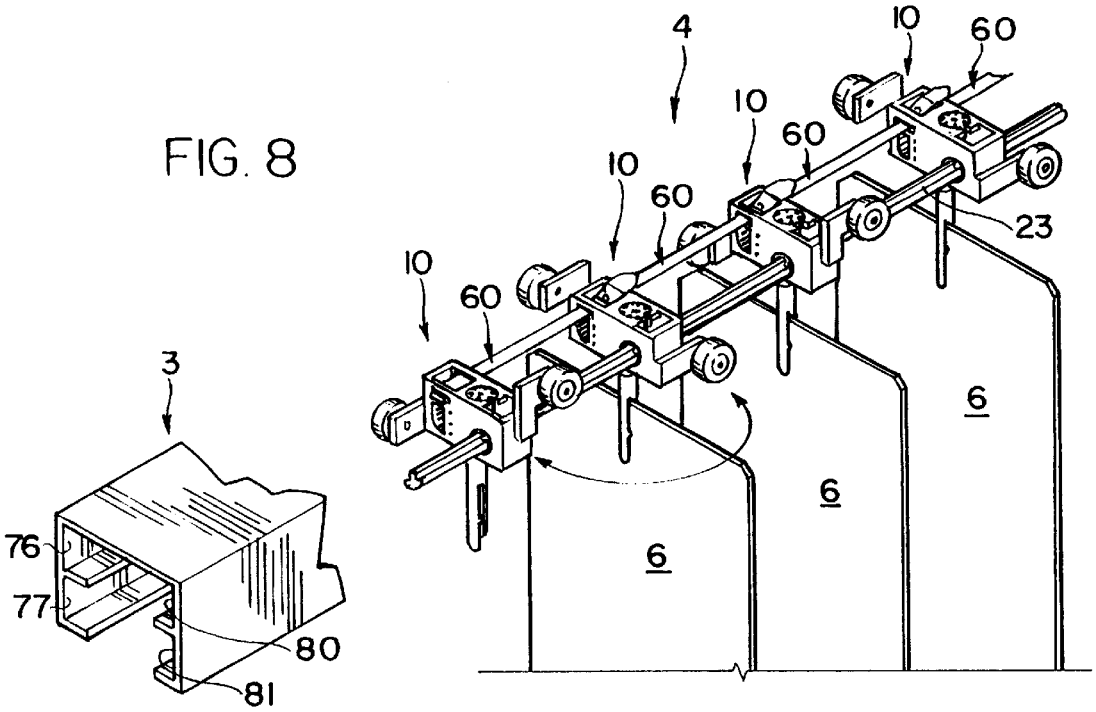

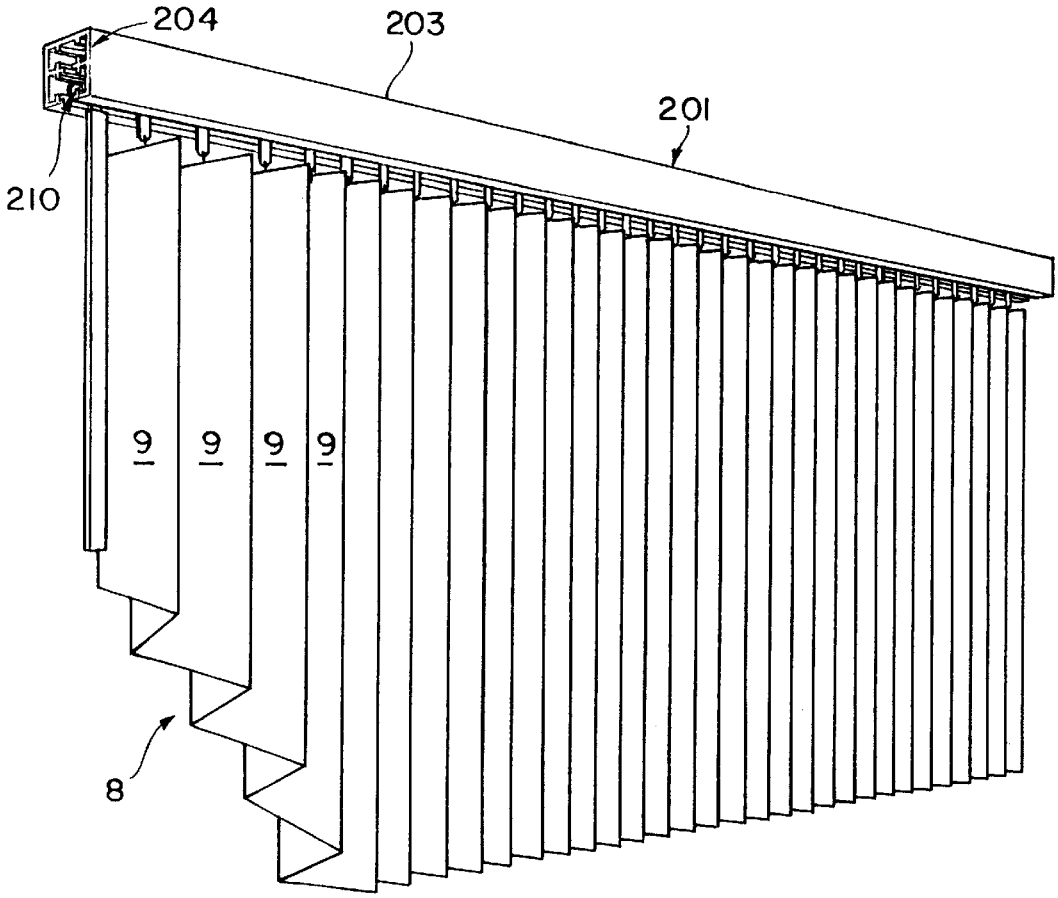
FIG. 13
FIG. 14
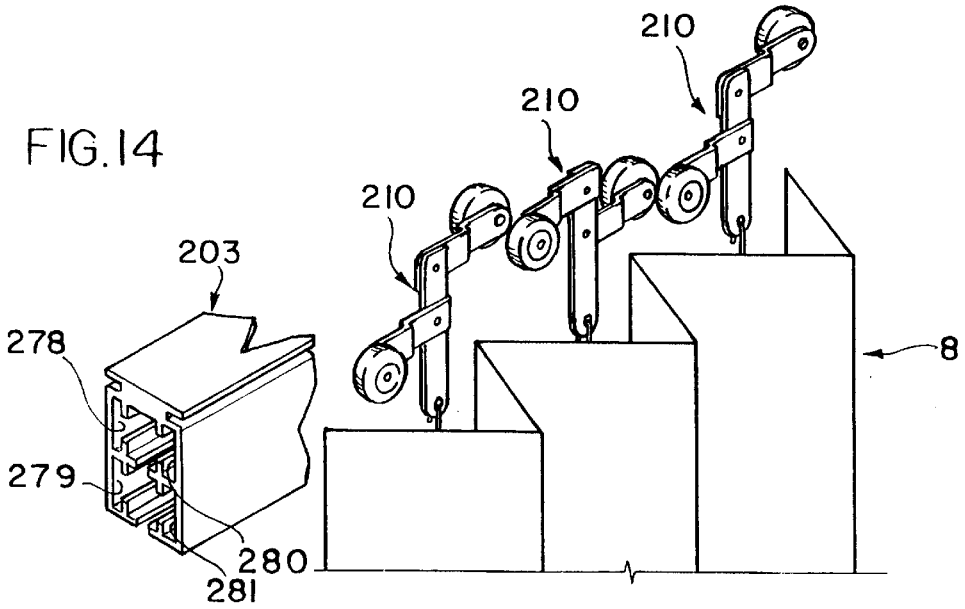

TRACK SYSTEM, INCLUDING STABILIZED, OFFSET-WHEEL CARRIERS

1. BACKGROUND OF THE INVENTION a. Field of the Invention

The present invention relates generally to window covering systems and, in particular, to traverse track mounting sytems suitable for use in window covering systems and to window covering systems using the carriers.

b. Definitions and Applicability

Typically, as used in the industry, "blinds" specifically refers to slat structures such as so-called venetian (horizontal slat) blinds, or vertical slat blinds, or so-called mini-blinds, or to flat, sheet structures such as the coverings used in roller blinds. "Covers" typically refers to pleated folding structures such as single pleat structures and box, hollow and cellular pleat structures. In this document, "cover" and "blind" are frequently used generically, in that "cover" includes "blind" and vice versa. It is believed the meaning which is intended—the generic or the specific—will be apparent from the context. Also, if and where used here, the terms "box" pleat blind, "hollow" pleat blind and "cellular" pleat blind are used interchangeably. Also, the words "carrier," "trolley" and "roller" are used interchangeably.

The present invention is applicable generally to vertically oriented window covering systems, including slat, folded pleat and cellular pleat covers. It is understood that "window," as used for example in "window covers," includes windows, doorways, openings in general and even non-opening regions to which "window coverings" are applied for decoration, display, etc.

The pleated blinds described here may be formed from lightweight fabric, which is effective in limiting total weight of the blind system. A series of pleats is formed in the fabric cover, for example, for providing a pleasing form to the cover, and for enabling the cover to be easily folded to facilitate opening and closing the blind. The lightweight fabric has a high degree of light transmission, for maximizing light transmission through the blind system when slats are in an open position. The fabric cover, however, has a high degree of diffusion for light transmitted therethrough. This combination of high transmission and high degree of diffusion is effective in providing privacy when the blind is open, while still providing adequate transmission of light through the cover and, thus, adequate daylight illumination. The fabric blind preferably is of pleated fabric such as the RIDEAU™ pleated cover.

c. Current State of the Relevant Field

Traverse tracks for vertical blinds include carriers or trolleys having wheels which are captured by the track, so that the carriers traverse along the track. Typically, the wheels are small, smaller than the longitudinal length of the carriers, to minimize interference between the wheels of adjacent carriers and thus permit the carriers to be closely packed when the associated blind is open (with the carriers bunched together). However, the use of small wheels increases rolling friction between the wheels and the track, and thus increases the force required to open and close the blind. In addition, the carrier mounting may be somewhat unstable and subject to pivoting and tilting.

2. SUMMARY OF THE INVENTION

In one embodiment, a three-dimension stabilized embodiment, the present invention is embodied in a track system for mounting a covering such as a window blind, and comprises (A) an elongated traverse track having horizontal length, transverse width and vertical height, and top, front and rear sides, and having a pair of elongated top internal tracks and a pair of elongated bottom internal tracks arranged in the vertical plane transverse to the longitudinal vertical plane of the track at upper front, upper rear, lower front and lower rear positions, thereby providing vertically and horizontally spaced apart carrier wheel positions. The track mounting system also includes (B) a plurality of carriers adapted for supporting a covering such as a slat or pleated blind thereto, which comprise (1) a chassis or body having first and second opposite sides extending transverse to the horizontal length of the traverse track, and also having front and rear edges; (2) first and second wheels; (3) a first arm member extending from a first of the edges proximate the bottom thereof in a first horizontal direction and mounting a first of the wheels at a position spaced away from the first side; and (4) a second arm member extending from the second of the edges proximate the top thereof in the opposite horizontal direction and mounting the second wheel at a position spaced away from the second side such that the two wheels are spaced apart along the horizontal length and transverse width of the traverse track and further are spaced apart vertically a distance sufficient to clear adjacent carriers. The longitudinal, transverse and vertical spacing between the two wheels adapts them for rotating capture in a first orientation in the bottom rear track and in the upper front track and in a second, reversed orientation, in the bottom front track and in the upper rear track, such that the alternating orientation of the adjacent carriers supported by the wheels captured in the top and bottom tracks permits the carriers to be close-packed with their chassis against one another, yet permits the diameter of the wheels to be larger than the longitudinal length of the carriers, thereby providing low rolling friction. The longitudinal, transverse and vertical spacing between the wheels suppress tilting or pivoting of the carriers in the longitudinal vertical plane, the transverse vertical plane, and the horizontal plane.

In another embodiment, a two dimension stabilized embodiment, the first and second wheels are mounted proximate the edges of the chassis at transversely and vertically spaced-apart positions, such that the vertical spacing between the two wheels is sufficient to clear adjacent carriers and the transverse and vertical spacing between the two wheels adapts them for rotating capture in a first orientation in the bottom rear track and in the upper front track and in a second, reversed orientation, in the bottom front track and in the upper rear track, such that the alternating orientation of the adjacent carriers supported by the wheels captured in the top and bottom tracks permits the carriers to be close-packed with their chassis against one another, yet permits the diameter of the wheels to be larger than the longitudinal length of the carriers, providing low rolling friction. The transverse and vertical spacing between the wheels suppress tilting or pivoting of the carriers in the transverse vertical plane and in the horizontal plane.

In yet another embodiment, the individual carriers comprise (1) a first, vertically elongated arm; (2) a second elongated arm mounted to the first arm at a first position and extending in a first direction horizontally; (3) a third elongated arm mounted to the first arm at a second position spaced vertically from the first position and extending in the opposite horizontal direction; and (4) first and second wheels mounted on the second and third arms, such that the two wheels are spaced apart along the horizontal length and transverse width of the traverse track and further are spaced apart vertically a distance sufficient to clear adjacent carriers. The longitudinal, transverse and vertical spacing between the two wheels adapts them for rotating capture in a first orientation in the bottom rear track and in the upper front track and in a second, reversed orientation, in the bottom front track and in the upper rear track such that the alternating orientation of adjacent carriers permits the carriers to be close-packed with their chassis against one another, yet permits the diameter of the wheels to be larger than the longitudinal length of the carriers, thereby providing low rolling friction. The longitudinal, transverse and vertical spacing between the wheels suppress tilting or pivoting of the carriers in the longitudinal vertical plane, the transverse vertical plane, and the horizontal plane. In a preferred embodiment, the first and second arms are offset in opposite transverse directions, increasing the transverse separation between the wheels.

In other alternative embodiments, not exhaustive, the chassis and arm members are formed integrally, as a unit, or are discrete members, assembled using fasteners.

Other embodiments of the present invention are described in the specification drawings and claims.

3. BRIEF DESCRIPTION OF THE DRAWINGS

The above and other aspects of the invention are described below in conjunction with the following drawings.

FIG. 7 is an exploded partial, perspective view of the window covering system of FIG. 1, partially cut away and revealing the carriers in the close-packed, blind open condition.

FIG. 8 is an exploded partial, perspective view of the window covering system of FIG. 1, partially cut away and revealing the carriers in a spaced-apart, blind (partially) closed condition.

FIG. 13 is a perspective view of a vertical pleat blind window covering system which uses an alternative, xyz carrier mechanism in accordance with the present invention.

FIG. 14 is an exploded partial, perspective view of the window covering system of FIG. 13, partially cut away and revealing the carriers in a spaced-apart, blind (partially) closed condition.

4. DETAILED DESCRIPTION OF THE PREFERRED EMBODIMENT(S)

a. XYZ-Offset Carrier and Associated Blind System, FIGS. 1–3, 5, 7–12

Figure 1:
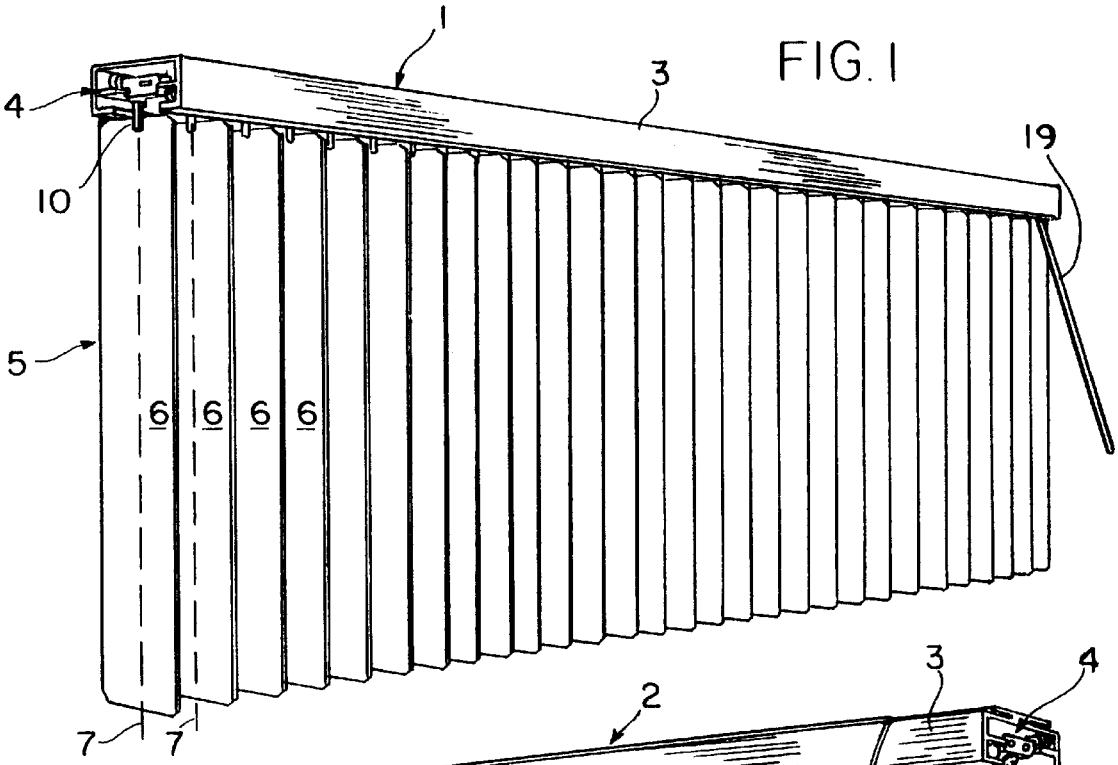
FIG. 1 is a perspective view of a vertical slat blind window covering system which uses a carrier mechanism in accordance with the present invention.
Figure 2:
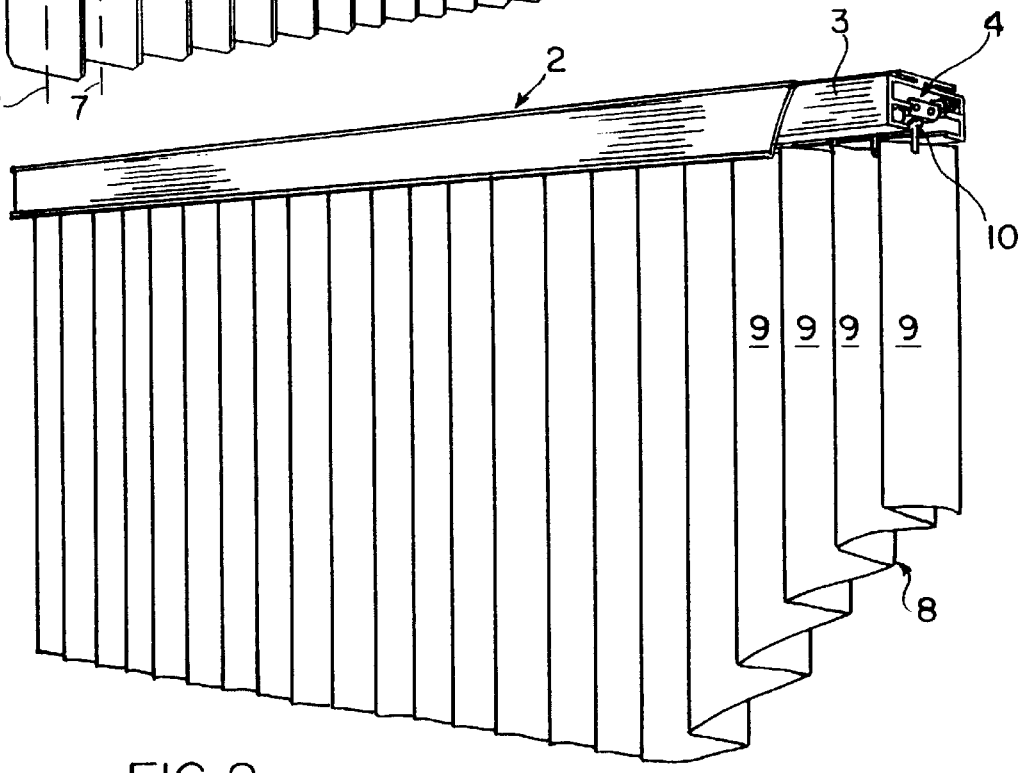
FIG. 2 is a perspective view of a vertical pleated blind window covering system which uses a carrier mechanism in accordance with the present invention.

FIGS. 1 and 2 depict alternative embodiments of window cover systems which include carriers or trolleys in accordance with the present invention. FIG. 1 is a perspective view of a vertical slat blind window cover system 1 comprising a horizontal track 3 which captures carriers or trolleys such as 10 of a carrier mechanism 4 for traverse along the track. Slats 6—6 of the blind 5 are mounted and suspended from the carriers 10 for opening and closing traversing movement along the track. Typically, the carrier mechanism 4 is adapted for rotating the carriers 10—10 in a horizontal plane to rotate the slats 6—6 about their vertical rotational axes 7—7.

FIG. 2 is a perspective view of a vertical pleat blind, window covering system 2, comprising the horizontal track 3 within which carriers or trolleys such as 10 are captured for traversing movement along the track, and a vertical pleated blind 8, having pleats 9—9, which is suspended from the trolleys or carriers 10—10 for opening and closing traversing movement along the track. As illustrated, the same trolley or carrier such as 10 can be used for both the vertical slat blind 5 and the vertical pleated blind 8. Typically the rotation function is unnecessary for pleated blinds. However, the pivoting carrier system 4 can be used and in some cases the reduced costs and the convenience associated with manufacturing and stocking a single carrier system for multiple uses may justify using the more complex pivoting carrier system 4 for vertical pleated blinds, rather than using a second, more simple, non-rotating carrier system.

Figure 3:
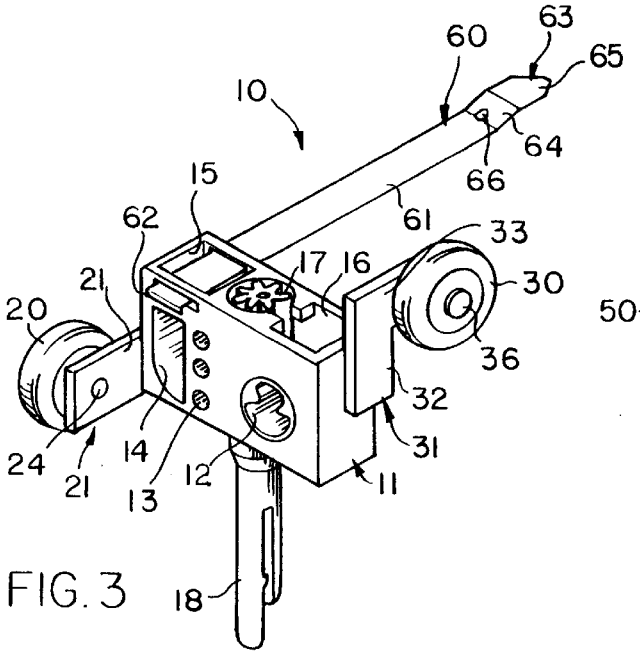
FIG. 3 is a perspective view of an xyz-displacement, integral carrier mechanism in accordance with the present invention.

FIG. 3 depicts a preferred embodiment of an integral xyz wheel-offset carrier 10 in accordance with the present invention. The carrier 10 comprises a chassis or housing 11 which is fitted with a worm gear rotating system. The worm gear includes a gear member 12 which is mounted in a horizontal through-hole in the chassis, and which is slidably mounted along a control rod 23 (see FIG. 8) that rotates the gear member 12. A second gear member 17 which mates with the first gear member 12, is positioned in a vertical hole and mounted on the upper end of hanger 18. The worm gear arrangement is perhaps shown most clearly in FIG. 12, which illustrates that reversible rotation of the rod about its longitudinal axis, see arrow 26, reversibly rotates the gears 13 and 17 and attached carrier 18, see arrow 27, to pivot the associated slat 6 open and closed. This rotation and the opening and closing traversal of the blind 5,8 is controlled by rotating wand 19, FIG. 1, and moving the wand back and forth along the track 3. This mechanism is well known in the art and thus will not be described in detail.

Referring further to FIG. 3, chassis 11 includes a second horizontal hole 14 through which the drapery system pull cord(s) is (are) routed and three vertically spaced-apart, horizontally extending through-holes 13—13 which are used to terminate the pull cords. That is, at the end of the associated blind, the pull cords on the end carrier unit are passed through hole 14 and then reversed and threaded through the holes 13 from the outside or endmost side of the carrier, and are knotted or otherwise terminated on the opposite, inside surface of the chassis 11. The chassis 11 also includes a through-slot 15 through which a spacing tail 60 is slidably mounted. The spacing tail 60 determines the maximum carrier-to-carrier and slat-to-slat spacing when the blind is in the closed condition and provides uniform spacing and a pleasing uniform appearance. The spacing tail 60 and the pullcord mechanisms are well known in the art and thus will not be described in detail here.

Traverse wheels 20 and 30, which support the carrier in the track and permit traversing movement along the track 3, are displaced or spaced apart from one another along the vertical (Z axis) and the horizontal (xy plane) to permit the use of large diameter wheels yet permit close packing of adjacent carriers 10—10 against one another, and to provide a stable platform for hanger 18 (and the associated blind such as slat blind 7 or pleated blind 8), which suppresses pivoting or tilting movement of the carrier. Specifically, the chassis 11 includes a horizontal arm member 21 which is positioned and mounted toward the bottom of one end (front or back end) of the chassis, and to which wheel 20 is rotatably mounted, for example by axle or screw or another suitable fastener 24. Wheel 30 is mounted on the opposite end (back or front end) of the chassis 11 and is spaced vertically and horizontally from wheel 20. In the preferred embodiment, an L-shaped arm member 31 is mounted to or preferably formed integrally with chassis 11 and has a vertical arm 32 and a horizontal arm 33, to which wheel 30 is rotatably mounted using axle or screw or other suitable fastener 36. As a result of this arrangement, the wheels are spaced-apart horizontally on opposite sides of the chassis 11 a distance x in the xy plane along the direction of traverse (FIG. 12); are spaced-apart horizontally on opposite sides of the chassis 11 a distance y in the yz plane transverse to the direction of traverse (FIG. 10); and are also spaced-apart vertically a distance z in the xz plane (FIG. 11). The unique xyz displacement/spacing/offset suppresses undesirable tilting or pivoting of the carriers and the slats mounted thereto in the xy plane about vertical axis Z (FIG. 12); in the xy plane about transverse axis Y (Y is transverse to the elongation of the track and the direction of traverse, see FIG. 11); and in the yz plane about the longitudinal axis X (along the direction of elongation and traverse, see FIG. 10).

Figure 10:
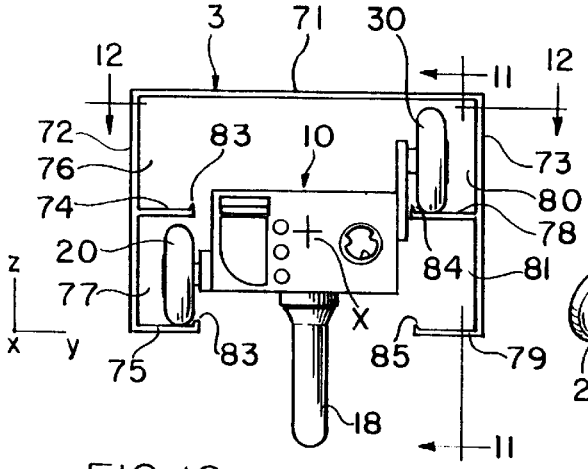
FIG. 10 is an end view of the track of FIG. 1, illustrating the capture of the carriers.
Figure 11:
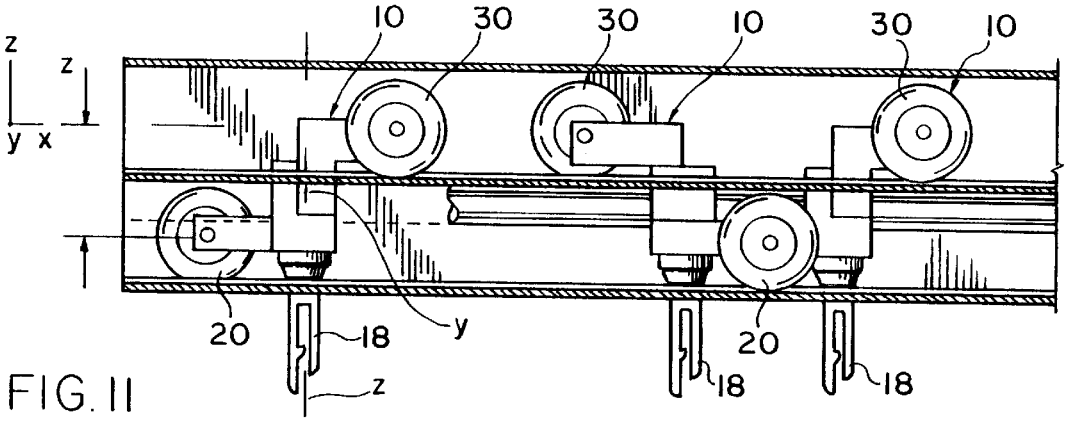
FIG. 11 is a vertical section view taken along line 11—11 in FIG. 10.

Referring also to FIGS. 7 and 10, the associated track 3 has a rectangular cross section defined by top 71, sides 72 and 73, and a bottom comprising longitudinally extending lips 75 and 79 between which is defined a longitudinally extending slot or opening 82. The track also includes interior, longitudinally extending lips 74 and 78, positioned on the opposite sidewall 72 and 73, which effectively divide the track into four c-shaped interior tracks or channels 76, 77, 80 and 81 which capture the wheels 20 and 30. More specifically, c-shaped upper rear track 76 is defined by sides/lips 71,72, 74; c-shaped lower front track 77 is defined by sides/lips 74, 72, 75; c-shaped upper front track 80 is defined by sides/lips 71, 73, 78; and c-shaped lower front track 81 is defined by sides/lips 78, 73, 79.

Referring now primarily to FIGS. 7–12, and initially to FIG. 8, preferably alternating carriers 10—10 are positioned in the track in alternating reverse orientation, with a first carrier 10 (position a) having the lower arm 21 and wheel 20 in either the rear track 77 or the front track 81. (Stated differently, the upper arm 33 and wheel 30 are positioned in the upper front track 80 or the upper rear track 76.) The next, longitudinally adjacent carrier 10 (section b) is positioned with the lower arm and wheel 20 in the lower front track 81 or the lower rear track 77. The next, third carrier 10 (position c) is positioned with the wheel 20 captured in the lower rear track 77 or lower front track 81. This alternating sequence is repeated down the track.

Figure 9:
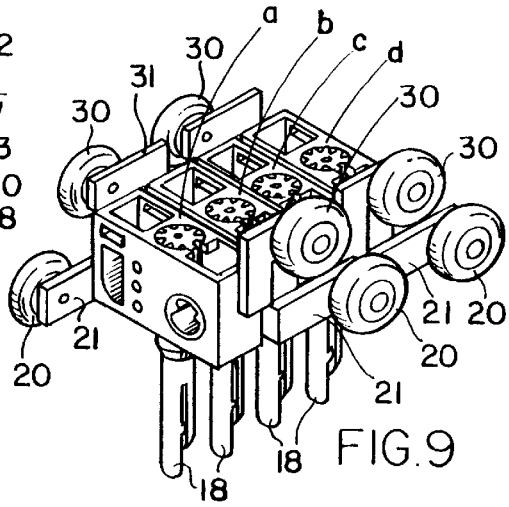
FIG. 9 is an enlarged perspective view of the close-packed carriers of FIG. 7.

Referring specifically to FIG. 9, as a result of the unique carrier construction and the alternating, reversing orientation, the arms and wheels do not interfere with the wheels of the adjacent carriers on either side thereof and adjacent carriers may be positioned against one another in close packed fashion, permitting close packing or bunching of the carriers and slats when the blind is open, such that the wheels of each carrier overlap one and one-half adjacent carriers on each side. In addition, and as is evident in FIG. 9, each wheel is spaced vertically and horizontally from adjacent wheels on either side and as a result, large wheels and their attendant reduced rolling distance can be used without sacrificing close packing. Finally, but not exhaustively, and as described above, the vertical and horizontally spacing or offset between the wheels suppresses tilting and pivoting about the vertical mounting axis of the hanger 18 and slats.

In one example of the xyz carrier 10, the track is 2½ in. wide and 1¾ in. tall; the four interior tracks 76, 77, 80 and 81 are ¼ in. wide and ¾ in. high; and the carrier chassis 11 is 7/16 wide, ¾ in. high, and 1⅜ in. long (front-to-rear, x dimension). The diameter of the wheels 20 and 30 is ¾ in. The associated x, y and z spacings are 2 in., 1½ in., and 2½ in., respectively.

Figure 5:
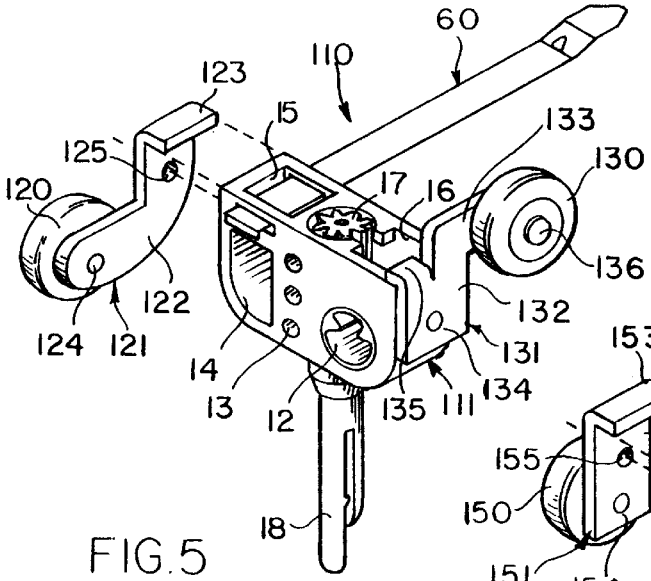
FIG. 5 is a perspective view of an xyz-displacement carrier mechanism in accordance with the present invention.

FIG. 5 depicts an alternative embodiment 110 of the xyz offset wheel carriage 10, in which the wheel assemblies (wheel and support arms) 121, 131 are discrete members which are preferably removably mounted to a separate carriage 111. The alternative embodiment 110 facilitates adding and/or replacing the wheel mounting assemblies 121, 131 and thus is useful for retrofitting existing carriages 111 on site with the wheel assemblies and for on site repairs in homes, offices, etc. Mounting arm member 121 comprises a generally L-shaped arm 122 and an angled top shoulder 123 which fit flush against the rear (front) and top edges of the chassis and are mounted on a screw (not shown) which extends through hole 125 in the arm member for attaching to a threaded hole (not shown) in the chassis. The mounting arm 131 for the second wheel 130 has legs 132 and 133 which form an L-shape and also has an angled shoulder 135 extending from vertical leg 132. The vertical leg 132 and the shoulder 135 fit flush against the front (rear) and top sides of the chassis 111 and the arm member 131 is attached to the chassis for example, by a screw or axle (not shown) which extends through a hole 134 in the arm member for attachment to a mounting in a mating hole in the chassis. Wheels 120 and 130 are mounted for rotation to arms 122 and 133 by fasteners 124 and 136 such as screws or axles. The L-shaped arms 121, 131 position the associated wheels 120 and 130 a distance beyond the sides of the chassis and also space the wheels vertically. This xyz displacement, the use of alternating reverse-oriented carriers 110—110 to provide close-packing, the use of large diameter wheels and the resulting benefits all are as described regarding carrier 10, FIG. 3.

b. YZ-Offset Carrier and Associated Blind System, FIGS. 4, 6

Figure 4:
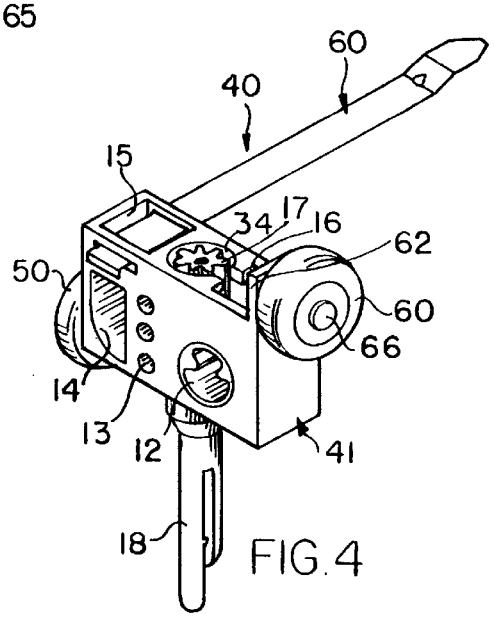
FIG. 4 is a perspective view of a yz-displacement, integral carrier mechanism in accordance with the present invention.

FIG. 4 depicts a carrier 40 of simple construction which provides vertical or yz displacement or spacing. The carrier 40 is similar to the carrier 10, FIG. 3, except that the first wheel 50 is mounted directly to the chassis (not on an extension arm) and the second wheel 60 is mounted to an extension arm 62 which is integrally formed with and extends vertically at the front (rear) side of the chassis. The wheel 60 is mounted on/by an axle/screw 66 which is mounted to the upper end of extension arm 62. The y and z separation between the carrier wheels 50 and 60 suppresses pivoting or tilting of the carrier in the yz plane around the X axis, without providing the xyz displacement and the associated xyz tilt suppression of carriers 10 and 110 or the close-packing provided by the combined xyz displacement of those carriers.

Figure 6:
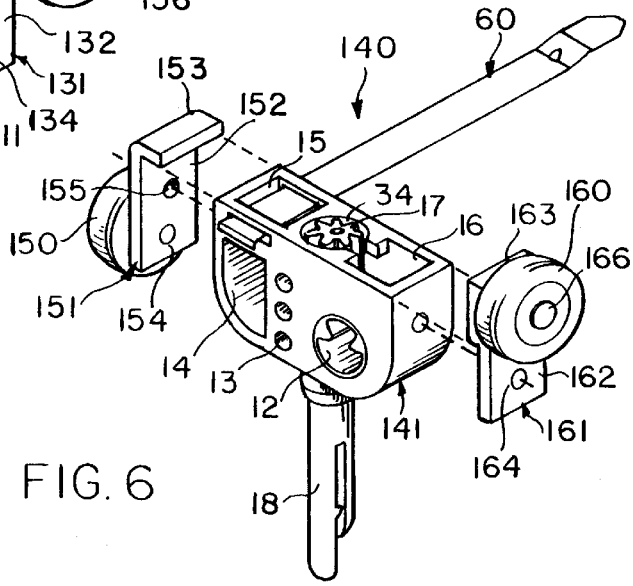
FIG. 6 is a perspective view of a yz-displacement carrier mechanism in accordance with the present invention.

FIG. 6 depicts a yz-only vertical displacement embodiment 140 which is an alternative to the integral yz-displacement carrier 40, FIG. 4. Extension arm member 151 for mounting the first wheel 150 comprises a vertically-oriented arm 154 and a shoulder 153 at the top. Arm 154 and shoulder 153 fit flush against the rear)front) side of the associate carrier 141 such that the member 151 is readily attached and removed by attaching/removing screw (not shown) via hole 155. Extension arm member 161 comprises a generally vertical arm 162 to which is attached a short backing member 163 which fits flush against the top side of the chassis 141 to aid the secure positioning of the extension arm on the chassis. Arm member 162 is attached to the front (rear) side of the chassis 141 by a screw (not shown) which extends through hole 164 in arm 162 for attachment to threaded hole in the chassis. The wheels 150 and 160 are mounted to/on fasteners 154 and 166 such as an axle or screw extending from the top of the arm 161. The yz-displacement carrier 140 functions the same as yz displacement carrier 40, FIG. 4, in that the y and z separation of the wheels suppresses pivoting or tilting of the carrier in the xz plane around the longitudinal X axis, without providing carrier 10's or carrier 110's xyz displacement and xyz tilt suppression or the close-packing provided by the combined xyz displacement.

C. XYZ-Offset Carrier and Associated Blind System, FIGS. 13–20

Figure 16:
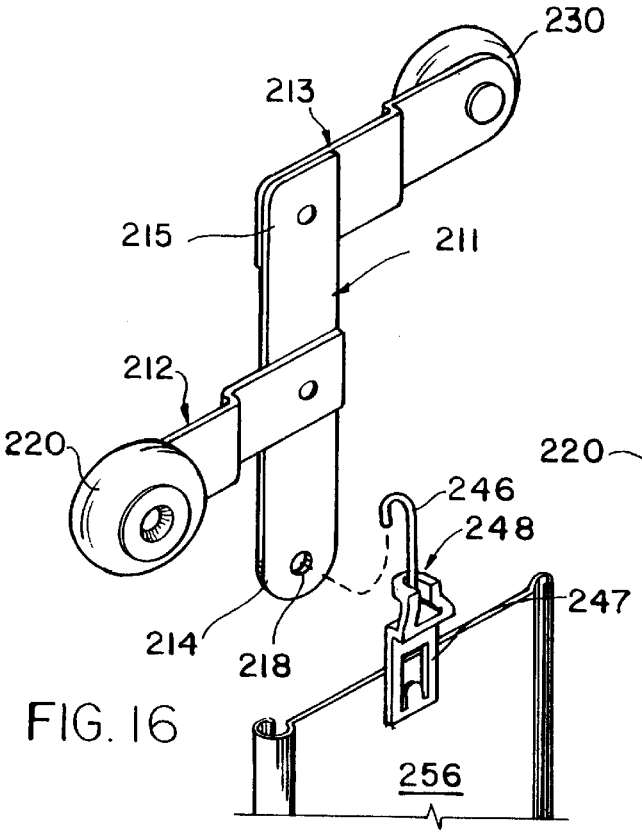
FIG. 16 is an exploded perspective view depicting a carrier of the type used in the system of FIGS. 13 and 14, in relationship to a slat and a slat support hook.
Figure 17:
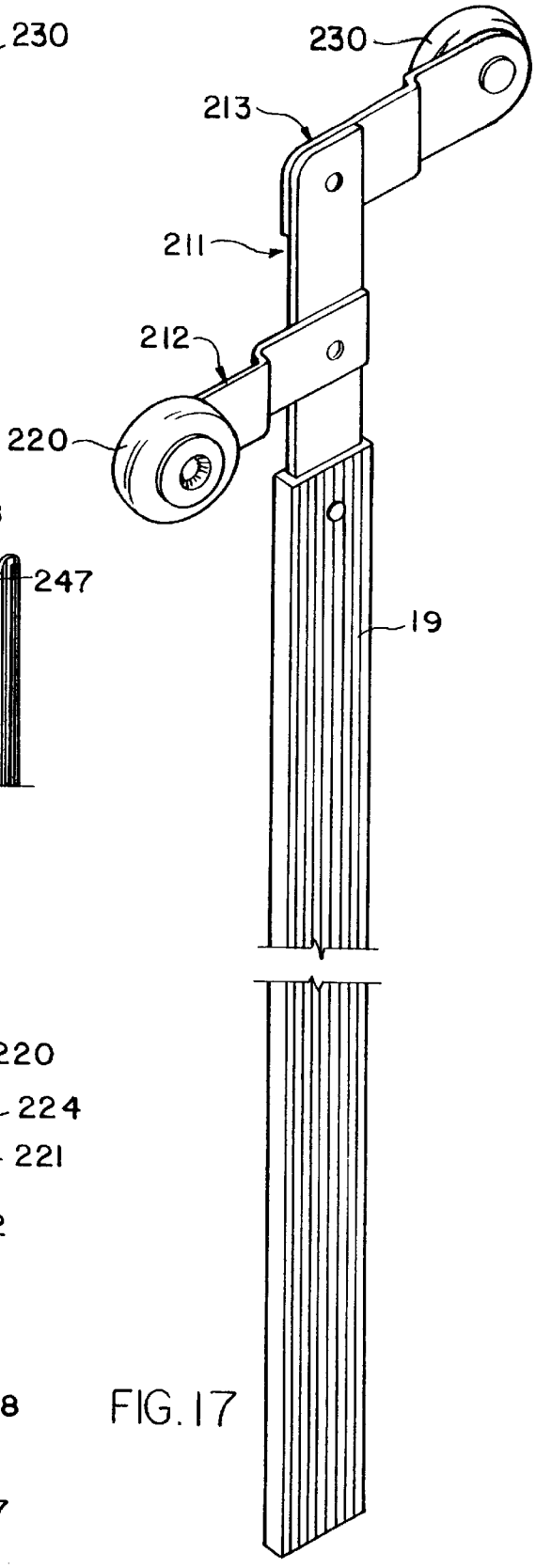
FIG. 17 is a perspective view depicting a carrier of the type used in the system of FIGS. 13 and 14, and a control wand mounted on the carrier.

FIGS. 13 and 14 are perspective views of yet another alternative window cover system 201, one which includes an alternative xyz system 204 of carriers or trolleys 210—210 in accordance with the present invention, which are captured by track 203 for traversal in opposite directions along the track to open and close a blind suspended from the carriers. As illustrated in FIG. 13, the carrier system 204 is well suited for supporting a vertical pleated blind such as 8. However, as indicated in FIG. 16, this carrier system is also well suited to mounting other types of blinds as well, including vertical slat blinds. As will be evident from the following discussion, functionally, the carrier system 204 differs from the, (xyz systems 10 and 110 in that the simple carriers 210 do not include rotating mechanisms and may be relatively narrow along the y dimension, and thus the associated y displacement/offset/spacing may be smaller than that of carriers 10 and 110.

Figure 15:
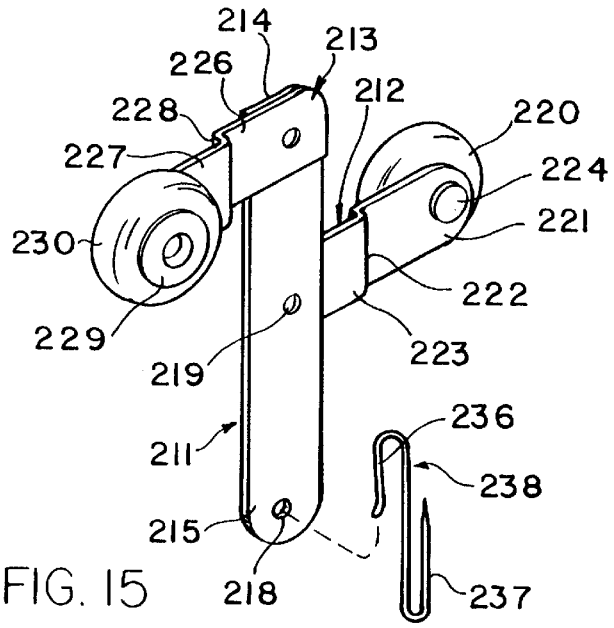
FIG. 15 is an exploded perspective view depicting a carrier of the type used in the system of FIGS. 13 and 14, in relationship to a blind support hook.
Figure 19:
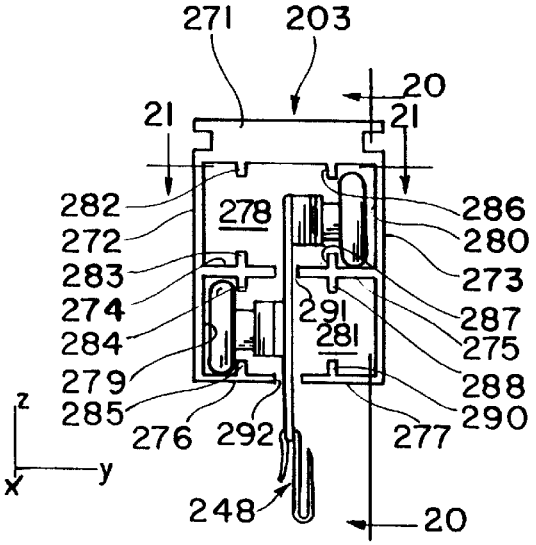
FIG. 19 is an end view of the track of FIG. 13, illustrating the capture of the carriers.

Referring to FIG. 15, the xyz carrier 210 comprises a vertical arm 211 having an upper end 214 and a lower end 215. A horizontal lower arm 212 is mounted to the vertical arm 211 intermediate the upper and lower ends 214 and 215 by a rivet, screw, weld, or other suitable fastener 219. The arm 212 comprises a first section 220, an intermediate shoulder or offset section 222 and a third, outer section 221. Wheel 220 is mounted for rotation on the second arm section 221 by an axle or rivet or other suitable fastener 224. Similarly, upper horizontal arm 213 comprises a first section 226, an intermediate shoulder or offset section 228 and a third, outer section 227. The first section 226 is mounted to the upper end 214 of the vertical arm 211, by a fastener 216. Second wheel 230 is mounted to the third arm section 227 by a rivet, screw or other suitable fastener 229. As illustrated, the associated blind 8 can be suspended from the carriers using a hanger such as the s-shaped member 238, which comprises a c-shaped upper hook 246 which is inserted through hole 218 in the carrier 210 and a second, lower c-shaped hook 237 from which the blind 8 is suspended. Similar to carriers 10 and 110, the wheels 220 and 230 of carrier 210 are mounted on the opposite sides (front and back) of the carrier and are spaced vertically and horizontally from one another in the x, y and z directions.

As a result of the above-described arrangement, including the oppositely offset arms 212 and 213, the wheels 220 and 230 are spaced-apart horizontally on opposite sides of the arm 211 a distance x in the xy plane along the direction of traverse; are spaced-apart horizontally on opposite sides of the arm 211 a distance y in the xy plane transverse to the direction of traverse; and are also spaced-apart vertically a distance z. Referring to FIGS. 18–21, the shoulders 222 and 228 offset the arms 213 and 212 in opposite directions along the y direction. Just as the width of the chassis 11 of carrier 10 determines the y spacing of carrier 10, the offset of the z-arms 212 and 213 (and the wheel spacers, see FIG. 21) determines the y spacing of the carrier 210. In addition, the z-shaped arms 212 and 213 overlap adjacent arms and contribute to the ability to close-pack the carriers against one another. The unique xyz displacement/spacing/offset suppresses undesirable tilting or pivoting of the carriers and the blind mounted thereto in the xy plane about vertical axis Z, see FIG. 20; in the xz plane about transverse axis Y (Y is transverse to the elongation of the track and the direction of traverse), see FIG. 20; and in the yz plane about the longitudinal axis X (along the direction of elongation and traverse), see FIG. 21.

Figure 21:
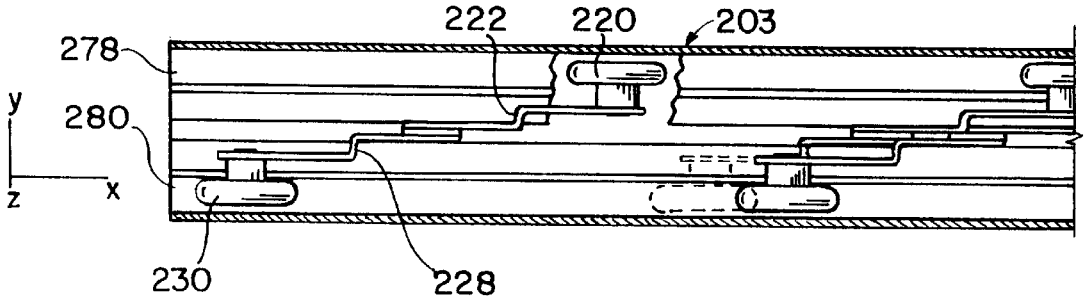
FIG. 21 is a horizontal section view taken along line 21—21 in FIG. 19.

Referring primarily to FIGS. 14 and 21, the track 203 has a rectangular cross section defined by top 271, sides 272 and 273, and a bottom comprising longitudinally extending lips 276 and 277 between which is defined a longitudinally extending slot or opening 292. The track 203 also includes interior, longitudinally extending lips 274 and 275, positioned on the opposite sidewalls 272 and 273, which effectively divide the track into four c-shaped interior tracks or channels 278, 279, 280 and 281, which capture the wheels 20 and 30. More specifically, the c-shaped upper rear track 278 is defined by sides/lips 282, 271, 272, 274, and 283. The c-shaped lower rear track 279 is defined by sides/lips 284, 274, 272, 276, and 285. Similarly the opposite side upper front c-shaped track 280 is defined by sides/lips 286, 271, 273, 275 and 287; and the opposite side lower front c-shaped track 281 is defined by sides/lips 288, 275, 273, 277 and 290.

Figure 18:
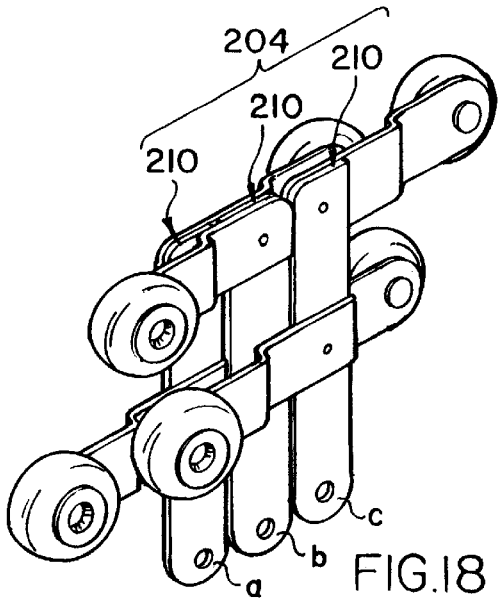
FIG. 18 is an enlarged perspective view of the carriers of FIG. 13, in the close-packed condition.
Figure 20:
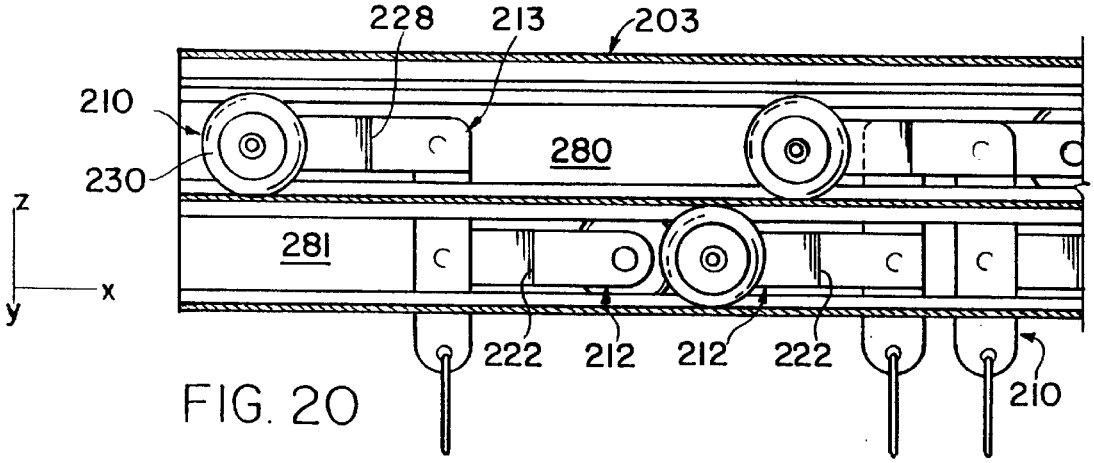
FIG. 20 is a vertical section view taken along line 20—20 in FIG. 19.

Referring now primarily to FIGS. 14 and 18, preferably alternating carriers 210—210 are positioned in the track in alternating reverse orientation, with one carrier 210 (position a) having the lower arm 212 and wheel 220 in either the rear track 279 or the front track 281. The next, longitudinally adjacent carrier 210 (position b) is positioned with the lower arm and wheel 220 in the lower front track 281 or the lower rear track 279. The next, third carrier 210 (position c) is positioned with the wheel 220 captured in the lower rear track 279 or lower front track 281. This alternating sequence is repeated down the track 203. As a result of the unique carrier construction and the alternating, reversing orientation, the arms and wheels do not interfere with the wheels of the adjacent carriers on either side thereof and adjacent carriers may be positioned against one another in close packed fashion, permitting close packing or bunching of the carriers and slats when the blind is open, such that the wheels of each carrier 210 overlap one and one-half adjacent carriers on each side. In addition, and as is evident in FIG. 18, each wheel is spaced vertically and horizontally from adjacent wheels on either side of it and as a result, large wheels and their attendant reduced rolling distance can be used without sacrificing close packing. Finally, but not exhaustively, and as described above, the vertical and horizontal wheel spacing/offset suppresses tilting and pivoting about the vertical mounting axis of the hanger 18 and slats.

In one example of the yz carrier 210, the track is 1⅝ in. wide and 1¾ in. high; the four interior tracks 278, 279, 280 and 281 are ¼ in. wide, and ¾ in. high. The diameter of the wheels 220 and 230 is ¾ in. The associated x, y and z spacings are 3 in., 1 in., and 1½ in., respectively.

FIG. 16 depicts the xyz offset wheel carriage 210 supporting slat 256, using a hanger 248 comprising an upper c-shaped hook such as 246 which is attached to the carrier 210 via hole 218 and a lower clip 247 which is attached to slot/slit (not shown) in the top of the associated slat.

Figure 22:
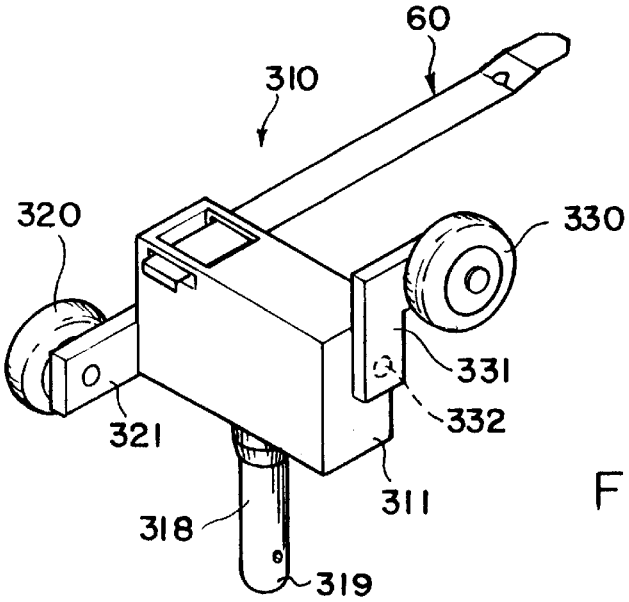
FIG. 22 is a perspective view of an xyz-displacement, carrier mechanism in accordance with the present invention.

FIG. 22 is a perspective view of an xyz-displacement, carrier mechanism 310, illustrating the wide range of components which can be used to implement the dual track (upper and lower tracks)and the spaced-apart, large carrier wheels which characterize the present invention. The carrier 310 includes a relatively wide y-dimension chassis 311 to which L-shaped arms 321 and 331 are mounted. By "mounted" I mean integrally formed with the chassis 311 or as indicated by the mounting hole 332 shown in phantom, attached to the chassis by screws or other fasteners. Wheels 320 and 330 are mounted to the arms 321 and 331. Alternatively, and depending upon the desired x, y and z wheel spacing, the arms can be straight, can be offset in the manner of FIG. 18, and/or one or both of the arms can be eliminated in favor of attaching the wheel(s) directly to the chassis 311. In addition, the chassis dimensions can vary, from a body which is thin as in FIG. 18 to a relatively wide body such as is that illustrated in FIG. 22.

Figure 12:
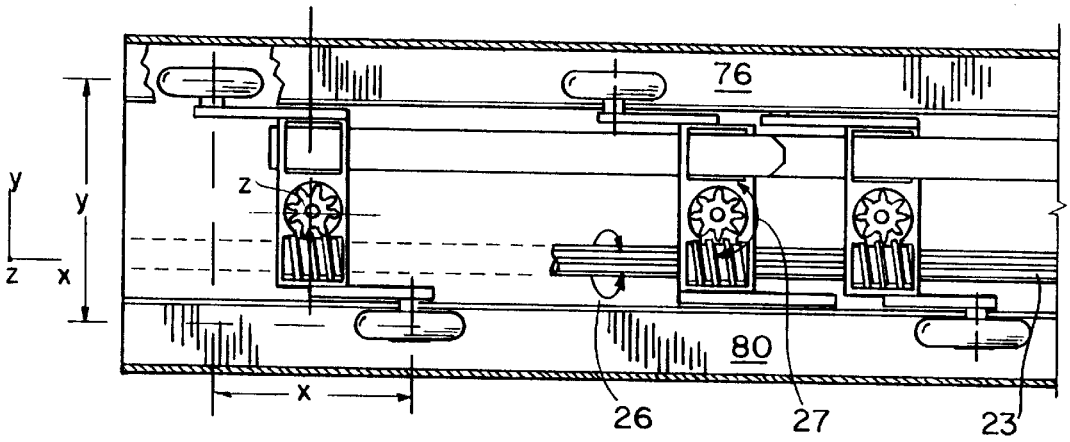
FIG. 12 is a horizontal section view taken along line 12—12 in FIG. 10.
Figure 23:
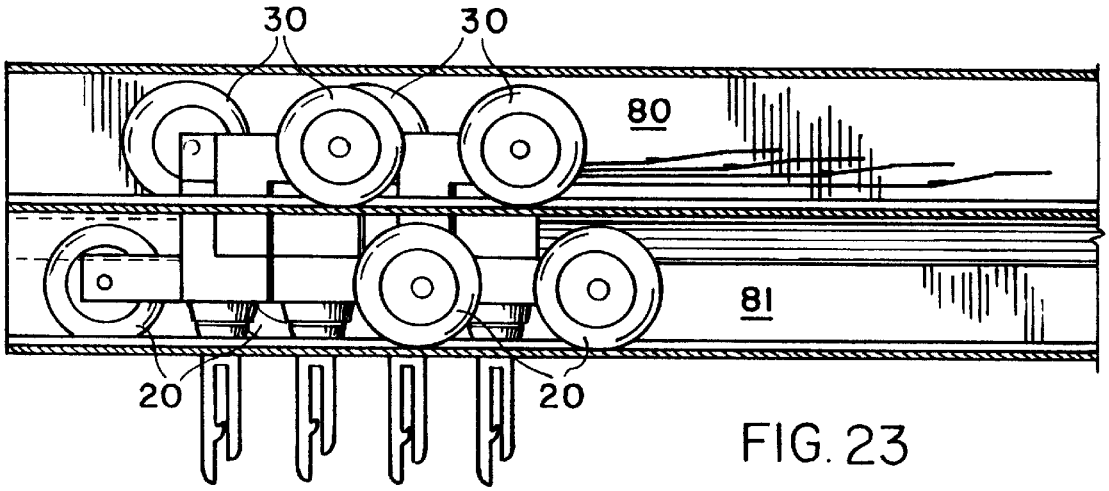
FIG. 23 is a vertical section view taken in the manner of FIG. 11, showing the carriers in the close-pack condition.
Figure 24:
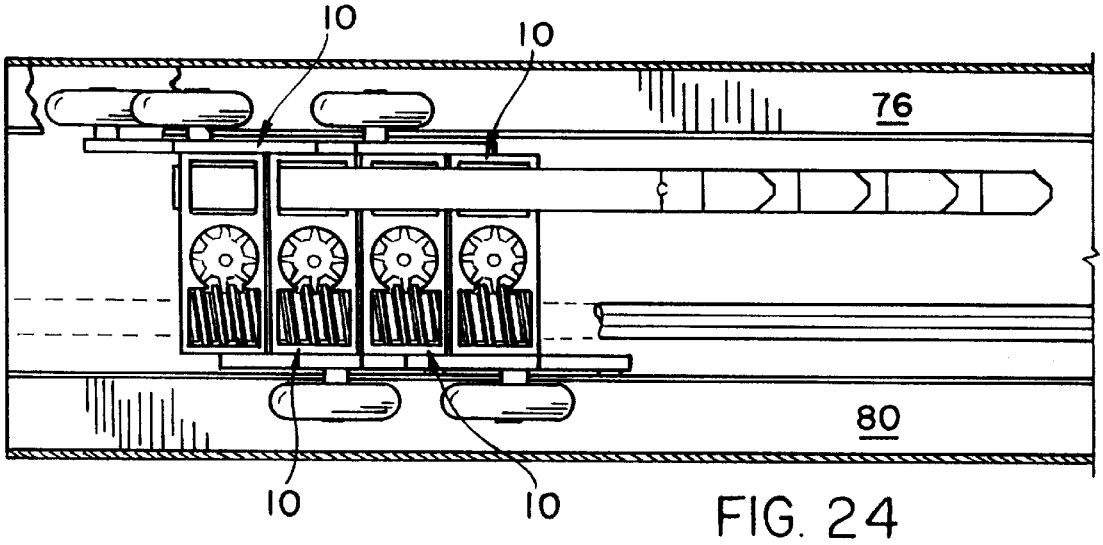
FIG. 24 is a horizontal section view taken in the manner of FIG. 12, showing the carriers in the close-pack condition.

FIG. 23 is a vertical section view similar to FIG. 11, and FIG. 24 is a horizontal section view, similar to FIG. 12, showing the manner in which the carriers 10 (also 110, 310, etc.) close-pack with the arms and wheels spaced apart. This allows adjacent chassis to touch or nearly touch. These figures also illustrate the generous spacing between wheels which would allow the use of even larger wheels. One of the examples herein used wheels which were twice the diameter of the wheels used with conventional tracks and carriers. FIGS. 23 and 24 (also FIGS. 11 and 12) illustrate, that even larger wheels can be used, providing ratios greater than 2:1, by changing the dimensions of the chassis and/or arms and the track, without affecting the ability to close-pack.

The present invention has been described in terms of a preferred and other embodiments. The invention, however, is not limited to the embodiments described and depicted. One familiar with the art to which the present invention pertains will appreciate from the various carriers and blind/cover arrangements disclosed here, that the present invention is applicable in general to articles, objects or systems designed for support by and traversal along tracks. Adaptation of the system to other articles, objects and systems, including other blinds will be readily done by those of usual skill in the art. The invention is defined by the claims appended hereto.

What is claimed is:

1. A track mounting system for a covering such as a window blind, comprising:

an elongated traverse track having horizontal length, transverse width and vertical height, and top, front and rear sides; the traverse track having a pair of elongated top internal tracks and a pair of elongated bottom internal tracks arranged in the vertical plane transverse to the longitudinal vertical plane of the track at upper front, upper rear, lower front and lower rear positions, thereby providing vertically and horizontally spaced apart carrier wheel positions;

a plurality of carriers adapted for supporting a covering such as a slat or pleated blind thereto, the individual carriers comprising:

a chassis or body having first and second opposite sides extending transverse to the horizontal length of the traverse track, and also having front and rear edges; a plurality of wheels consisting of first and second wheels; a first arm member extending from a first of the edges proximate the bottom thereof in a first horizontal direction and mounting a first of the wheels at a position spaced away from the first side; a second arm member extending from the second of the edges proximate the top thereof in the opposite horizontal direction and mounting the second wheel at a position spaced away from the second side such that the two wheels are spaced apart along the horizontal length and transverse width of the traverse track and further are spaced apart vertically a distance sufficient to clear adjacent carriers; the longitudinal, transverse and vertical spacing between the two wheels adapting them for rotating capture in a first orientation in the bottom rear track and in the upper front track and in a second, reversed orientation, in the bottom front track and in the upper rear track such that the alternating orientation of adjacent carriers supported by the two wheels captured in the top and bottom tracks permits the carriers to be close-packed with their chassis against one another, and wherein the diameter of the two wheels is larger than the longitudinal length of the carriers, thereby providing low rolling friction; and the longitudinal, transverse and vertical spacing between the two wheels suppressing tilting or pivoting of the carriers in the longitudinal vertical plane, the transverse vertical plane, and the horizontal plane.

2. A track mounting system for a covering such as a window blind, comprising:

an elongated traverse track defining four internal elongated tracks arranged in a generally rectangular array in a plane transverse to the direction of elongation of the track at upper front, upper rear, lower front and lower rear positions, x, y and z coordinate axes corresponding to the length, transverse width and height of the track;

a plurality of carriers adapted for mounting a covering such as a slat or pleated blind thereto, the individual carriers comprising:

a chassis or body having first and second opposite sides extending in the y direction transverse to the elongated track, and first and second opposite edges; a plurality of wheels consisting of first and second wheels; a first arm member extending from a first of the edges proximate the bottom thereof in a first x direction and mounting a first of the wheels at a position spaced away from the first side proximate the bottom thereof; a second arm member extending from the second of the edges proximate the top thereof in the opposite x direction and mounting the second wheel at a position spaced away from the second side proximate the top thereof such that the two wheels are spaced apart in the z direction as well as in the x and y directions; the x, y and z spacing between wheels adapting them for rotating capture in a first orientation in the bottom rear track and the upper front track and in a second, reversed orientation, in the bottom front track and the upper rear track such that alternating orientations of adjacent carriers permits the carriers to be close-packed against one another independent of wheel size; and the x, y and z spacing between the wheels captured within the associated tracks suppressing tilting or pivoting of the carriers about associated x, y and z axes.

3. The track mounting system of claim 2, wherein the chassis and arm members are formed integrally, as a unit.

4. The track mounting system of claim 2, wherein the chassis and arm members are discrete members, assembled using fasteners.

5. A track mounting system for a covering such as a window blind, comprising:

an elongated traverse track having horizontal length, transverse width and vertical height, and top, front and rear sides; the traverse track having four internal elongated tracks arranged in a generally rectangular array in the vertical plane transverse to the longitudinal vertical plane of the track at upper front, upper rear, lower front and lower rear positions;

a plurality of carriers adapted for supporting a covering such as a slat or pleated blind thereto, the individual carriers comprising:

a chassis or body having first and second opposite sides extending transverse to the horizontal length of the traverse track, and also having front and rear edges; a plurality of wheels consisting of first and second wheels mounted proximate the edges of the chassis at transversely and vertically spaced-apart positions, the vertical spacing being sufficient to clear adjacent carriers; the transverse and vertical spacing between the two wheels adapting them for rotating capture in a first orientation in the bottom rear track and the upper front track and in a second, reversed orientation, in the bottom front track and the upper rear track such that the alternating orientation of adjacent carriers permits the carriers to be close-packed with their chassis against one another, independent of wheel size; and the transverse and vertical spacing between the wheels suppressing tilting or pivoting of the carriers in the transverse vertical plane and in the horizontal plane.

6. A track mounting system for a covering such as a window blind, comprising:

an elongated traverse track defining four internal elongated tracks arranged in a generally rectangular array in a plane transverse to the direction of elongation of the track at upper front, upper rear, lower front and lower rear positions, x, y and z coordinate axes corresponding to the length, transverse width and height of the track;

a plurality of carriers adapted for mounting a covering such as a slat or pleated blind thereto, the individual carriers comprising:

a chassis or body having first and second opposite sides extending in the y direction transverse to the elongated track, and first and second opposite edges; a plurality of wheels consisting of first and second wheels mounted proximate the first and second edges of the chassis at positions spaced apart along the y direction; the associated y and z spacing between wheels adapting them for rotating capture in a first orientation in the bottom rear track and the upper front track and in a second, reversed orientation, in the bottom front track and the upper rear track such that alternating first and second orientations of adjacent carriers permits the carriers to be close-packed against one another independent of wheel size; and the y and z spacing between the wheels captured within the associated tracks suppressing tilting or pivoting of the carriers about associated x and y axes.

7. The track mounting system of claim 6, wherein at least one of the two wheels is mounted on an arm member mounted proximate one edge of the chassis and extending in the in the z direction, thereby increasing the spacing between the wheels along the z axis.

8. The track mounting system of claim 7, wherein the chassis and the at least one arm member are formed integrally, as a unit.

9. The track mounting system of claim 7, wherein the chassis and the at least one arm member are discrete members, assembled using fasteners.

10. The track mounting system of claim 6, wherein the first wheel is mounted on a first arm member mounted proximate a first edge of the chassis and extending in a first z direction away from the chassis, and the second wheel is mounted on a second arm member mounted proximate the second edge of the chassis and extending in the opposite z direction away from the chassis, thereby increasing the spacing between the wheels along the z axis.

11. The track mounting system of claim 10, wherein the chassis and the arm members are formed integrally, as a unit.

12. The track mounting system of claim 10, wherein the chassis and the arm members are discrete members, assembled using fasteners.

* * * * *